US005225069A

United States Patent [19]

Haupt et al.

[11] Patent Number: 5,225,069

[45] Date of Patent: Jul. 6, 1993

[54] PROCESS FOR THE PRODUCTION OF OXIDE CERAMIC SURFACE FILMS ON SILICON-CONTAINING LIGHT METAL CAST ALLOYS

[75] Inventors: Kerstin Haupt; Jurgen Schmidt; Ullrich Bayer; Thomas Furche, all of Jena, Fed. Rep. of Germany

[73] Assignee: Jenoptik GmbH, Jena, Fed. Rep. of Germany

[21] Appl. No.: 884,691

[22] Filed: May 18, 1992

[30] Foreign Application Priority Data

May 21, 1991 [DE] Fed. Rep. of Germany ..... 4116910

[51] Int. Cl.[5] ..... C25D 11/16

[52] U.S. Cl. ..... 205/325; 205/332

[58] Field of Search ..... 205/325, 332

[56] References Cited

FOREIGN PATENT DOCUMENTS 28399 2/1991 Japan .

*Primary Examiner*—T. M. Tufariello

*Attorney, Agent, or Firm*—McAulay Fisher Nissen Goldberg & Kiel

[57] ABSTRACT

A process for the production of white and black oxide ceramic surface films on silicon-containing light metal cast alloys by plasma-chemical anodic oxidation. An aluminum cast alloy is pickled with nitric acid and hydrofluoric acid and coated by plasma-chemical anodic oxidation in an aqueous electrolyte. Accordingly, a coating variant is provided particularly for construction parts of silicon-containing light metal cast alloys having complicated shapes which enables the production of uniformly thin oxide ceramic surface films in contrast to conventional coating variants.

8 Claims, 2 Drawing Sheets

PROCESS FOR THE PRODUCTION OF OXIDE CERAMIC SURFACE FILMS ON SILICON-CONTAINING LIGHT METAL CAST ALLOYS

BACKGROUND OF THE INVENTION a) Field of the Invention

The invention is directed to a process for the production of white and black oxide ceramic surface films on silicon-containing light metal cast alloys by means of plasma-chemical anodic oxidation.

b) Background Art

It is known to produce high-adhesion, dense and thick dispersion films on metals, especially on iron and iron work materials, by means of anodic arc-discharge or conventional thermal treatment by deposition from dispersion systems (DD-PS 151330).

The disadvantage in this solution consists in that a constant stirring of the suspension must be carried out to prevent the precipitation of the dispersion suspension;

a subsequent annealing must be effected at 900° after depositing the films so that the process is unsuitable for light metals;

no data are indicated in the patent concerning adhesion strength.

The patents DD 142 359, DD 142 360, DD 151 331, DD 205 197, DD 209 661 and DD 218 637 describe processes for the production of oxide films on aluminum work materials or bonds on aluminum work materials by means of ANOF processes. A disadvantage in these processes, as in those listed above, consists in that there is either no data concerning the utilized electrolytes DD 151 331;

or that all electrolytes contain fluoride and accordingly raise problems with respect to disposal;

there are no concrete data concerning adhesion strength of the produced film - PS DD 142 360, DD 218 637;

only a decreased adhesion strength can be expected due to the occurrence of a "grainy" surface - PS DD 142 360, there are no data concerning resistance to corrosion or the produced film - PS-DD 209 661, DD 218 637;

and costly secondary treatments place higher demands on the production technology.

PS DE 17 711 A1 describes an electrolyte for producing high-adhesion, deep-black conversion films on light metals or their alloys which are realized by means of ANOF processes. Also, electrolytes for the production of extremely thin black conversion films and electrolytes for producing white, thermal-shock-resistant, high-adhesion, oxide ceramic surface films on light metals and their alloys which are likewise realized by means of plasma-chemical anodic oxidation have become known recently.

The significant disadvantage of all these listed solutions consists in that they are not suitable as variants for providing films on light metal cast alloys by means of plasma-chemical anodic oxidation.

It is likewise known from the technical literature as described e.g. in Pocketbook for Galvanic Technology [Taschenbuch für Galvanotechnik], volume 1, Process Technology [Verfahrenstechnik], 13th edition 1988, LPW-Chemie GmbH, W-4040 Neuss) to produce thin oxide films on aluminum work materials, also including aluminum cast alloys, by means of electrochemical anodic oxidation, especially eloxing processes. This method requires the following process steps e.g. for preparing aluminum cast alloys for anodic oxidation:

degreasing with conventional degreasing agents or in an ultrasonic bath;

pickling in 10–20-percent caustic soda lye (NaOH)

passivation in 10-percent nitric acid (HNO3)

rinsing in distilled water between each process step.

A disadvantage in these coating variants consists in that they are unsuitable for producing thin uniform oxide films particularly on structural component parts having complicated shapes. The use of such coating variants is therefore very limited and therefore basically inadequate in optical precision equipment construction.

Further, the following solutions for the pretreatment of surfaces of aluminum work materials are known from the patent literature:

DD 235 442—treatment of the aluminum surface with a mixture of a water glass solution MgO, CaO, NaOH and water for producing an adhesive base for pur [polyurethane]-coating systems;

DD 239 927—two-step etching processes for eliminating lattice imperfections due to mechanical isolating processes and for defined surface roughening in $A_{III}$-$B_{V}$-semiconductor components by 1. polishing treatment in a solution of phosphoric acid, hydrogen peroxide and water;
2. etching for uniform texturing in phosphoric acid, hydrogen peroxide or sulfuric acid and hydrogen peroxide;

DD 251 905—improvement of the adhesive and contact behavior of metal films on p+-conductivity zones of $A_{III}$- $B_{V}$-semiconductor components by treating the surface with etching baths consisting of:

a mixture of hydrofluoric acid, hydrogen peroxide and water and a second mixture of sulfuric acid, hydrogen peroxide and water;

DE-OS 34 05 437—alkaline bath for decorative etching of aluminum and its alloys comprising sodium hydroxide NaOH, sodium carbonate $Na_2CO_3$, sodium tripolyphosphate $Na_5P_3O_{10}$, potassium hydroxide $Ca(OH)_2$, copper fluoride $CuF_2$, sodium nitrate $NaNO_3$ and sodium nitrite $NaNO_2$;

DE-OS 35 37 584—process and apparatus for preventing corrosion after carrying out plasma etching on aluminum, wherein $SiCl_2$, $Cl_2$ and $AlCl_3$ are formed individually or together;

GB 8 227 118—cleaning of aluminum surfaces to be anodized by means of hexafluorophosphoric acid II [$PF_6$] and possibly nitric acid $HNO_3$;

U.S. Pat. No. 359 339—process for electrochemical roughening of aluminum or its alloys in an aqueous electrolyte comprising nitric acid, oxalic acid and possibly additions of boric acid, aluminum nitrate and/or hydrogen peroxide.

Common to all of these solutions is that:

they are not suitable for the selective etching of the respective surface and accordingly cannot be used for pretreatment and the preparation of the surface for a plasmachemical anodic oxidation on light metal cast alloys incident thereto;

and they sometimes involve very costly devices and process steps;

the pretreatment, e.g. in DD-PS 235 442, is not sufficient for producing protective layers with high adhesive strength. Such protective layers have the disadvantage of a low service life and have short maintenance cycles with susceptibility to corrosion resulting in warping and tearing.

DE-OS 27 30 953 describes a wet-chemical etching process for producing highly roughened surfaces, but which has the disadvantage that additional under-etchings at the edge areas, e.g. edge undercuts, are brought about which favor mechanical destruction processes during further processing.

U.S. Pat. No. 40 94 752 describes a wet-chemical etching process by means of an etching solution based on HF and $HNO_3$. In this case the following disadvantages should be mentioned particularly:

that no reproducible roughening of the surface is possible and that there is a precipitation of decomposition products on the surface.

A number of different processes are known from the patent literature for the pretreatment of surfaces of chiefly siliconcontaining work materials:

dry processes such as plasma etching; U.S. Pat. No. 730 988, DE-OS 36 27 311, DE-OS 29 30 290, DE-OS 29 30 293, U.S. Pat. No. 39 40 504, U.S. Pat. No. 40 69 096, DE-OS 34 20 347 ionic etching, DE-OS 30 45 922 cathodic atomization and the like.

The disadvantages of these processes particularly consist in that the surface to be etched must undergo a costly pretreatment prior to the actual, possibly selective etching process, e.g. the surface is coated with an organic resist, irradiated and developed at certain places. This results in a resist mask which exposes certain surface areas which are etched in the subsequent work step;

in a bombardment with high-energy particles, radiation damage such as lattice imperfections, which impede or prevent further processing of the etched surface, can occur in the remaining material;

in that a high resist erosion occurs, likewise as a result of the aforementioned bombardment;

and in that there is unwanted etching of a layer of the body situated below the layer to be etched or disturbing undercuts.

wet-chemical etching processes

U.S. Pat. No. 8 75 833—etching solution and process for etching silicon by means of ethanolamine, piperidine, $H_2O$, pyrocatechol and $H_2O_2$;

DE-OS 29 50 54—cleaning of the surfaces of silicon plates by means of hydrofluoric acid;

JP-PS 139 620/84—etching of a polycrystalline silicon film by means of nitric acid and hydrogen peroxide;

U.S. Pat. No. 637 874—production of an electronically passivating surface on crystalline silicon by means of hydrofluoric acid and an organic upper layer in an atmosphere of inert gas.

These solutions are disadvantageous in that no exact compositions of the etching agent are indicated to some extent;

the "etching" process step is implemented only in apparatuses of complicated construction;

and material is removed only over the entire surface of the work material to be etched;

in that consequently no strictly controllable etching profiles can be provided;

and in that extensive masking work must be carried out for a possible selective etching.

Further, processes for selective etching of silicon films are known from the patent literature:

DD-PS 208 886—selective etching of phosphorous-doped silicon films in a hydrofluoric acid containing etching medium, wherein the silicon dioxide films must be tempered in a hydrogen atmosphere at 600 to 1000° C. to reduce the high etching rate;

DD-PS 238 622—selectively acting etching agents for etching doped silicon dioxide or silicon glass films. This etching agent comprises hydrofluoric acid and an organic solvent of low polarity which can be mixed with water, preferably dioxane. Concrete data on the selectivity of the etching rate of the etching agent and for the selective removal of the silicon surfaces are not indicated.

DD-PS 206 168—etching agent for structuring polycrystalline silicon films comprising a mixture of acetic acid, hydrofluoric acid, nitric acid, water, silver nitrate and a catalytic amount of nitrite ions. Here also there is no concrete data on the selectivity of the etching rate of the etching agent and for the selective removal of the polycrystalline silicon surfaces.

U.S. Pat. No. 793 402—etching solution and etching process for doped silicon comprising hydrofluoric acid, nitric acid or acetic acid. Again, there are no data on the etching rate selectivity of the etching agent.

DD-PS 249 706—etching agent for etching silicon dioxide or silicon dioxide-containing glasses on semiconductor materials which are partially covered with aluminum. The etching agent comprising a sodium salt, a diluted hydrofluoric acid, and a cationic surface-active tenside is supposed to prevent the removal of the aluminum during the SiO2 etching. This solution is disadvantageous in that this form of structuring of silicon dioxide is selective, but not sufficient for preparing the work material for further processing, e.g. the plasma-chemical anodic oxidation for producing oxide ceramic surface films on light metal cast alloys.

The disadvantage of all of the listed solutions in addition to those disadvantages already listed consists in that a removal of material is fundamentally effected over the entire surface of the work material with the wet-chemical etching process;

extensive pretreatments in the form of masking processes must be carried out in part in order to enable a selective etching;

a selective etching without masking processes is possible in certain cases, but no controllable etching profiles can be produced;

and such variants of etching are inadequate for further processing of the work material with respect to its qualitative parameters, e.g. with respect to the production of oxide ceramic films by means of plasma-chemical anodic oxidation on light metal cast alloys.

OBJECT AND SUMMARY OF THE INVENTION

A primary object of the present invention is to develop a process which makes possible the production of oxide ceramic surface films on silicon-containing light metal cast alloys. This object is met, according to the invention, in that the light metal cast alloy is pickled in a mixture containing 10 parts by volume of a 45 to 65-percent nitric acid to 1 part by volume of a 30 to 48-percent hydrofluoric acid and coated by means of plasma-chemical anodic oxidation in an aqueous electrolyte comprising potassium dihydrogen phosphate, potassium chromate, acetate ions, ammonium citrate and ethylenediamine for the production of black oxide ceramic surface films or comprising potassium dihydrogen phosphate, sodium carbonate, ethylenediamine and an ammonia solution for the production of white oxide ceramic surface films at a current density of 0.01–0.1 $A \cdot cm^{-2}$ of a pulsed current at a frequency of 200 1000 Hz and a voltage of 250–320 V. Additional water can be added to the mixture in which the cast alloy is pickled. An aluminum cast alloy is preferably used as silicon-containing light metal cast alloy. A selective dissolving process is verifiably triggered on the surface of the silicon-containing light metal cast alloy by the pickling process which effects an enrichment of the surface in chief alloy metals. According to the invention, the precondition is accordingly provided for producing oxide ceramic films by means of plasmachemical anodic oxidation on light metal cast alloys. The advantage of the solution, according to the invention, consists in that, in contrast to conventional coating variants, even structural component parts of light metal cast alloys having complicated shapes can be coated with uniformly thin oxide ceramic surface films by means of plasma-chemical anodic oxidation.

For a better understanding of the present invention, reference is made to the following description and accompanying drawings while the scope of the invention will be pointed out in the appended claims.

DETAILED DESCRIPTION OF THE INVENTION

The invention is explained with the aid of the following preferred examples which do not limit the invention:

EXAMPLE 1

An aluminum cast part which comprises the alloy G-AlSi1OMg and is degreased in an ultrasonic bath is pickled in a mixture of 10 parts nitric acid $HNO_3$ (65-percent)

part hydrofluoric acid HF (48-percent) at room temperature for 15 s.

After a rinsing process under running water the aluminum cast part is operated as anode in an electrolyte bath comprising an aqueous solution of 0.59 mole/l 80 g/l potassium dihydrogen phosphate—KH2PO4;

0.05 mole/l=10 g/l potassium chromate—$K_2CrO_4$;

0.35 mole/l=70 g/l potassium acetate—Cu $[CH_3COO]_2.H_2O$;

0.22 mole/l=50 g/l ammonium citrate and 0.38 mole/l=100 ml/l ethylenediamine and coated by means of the plasma-chemical oxidation at a current density of 0.05 $A \cdot cm^{-2}$, at a frequency of 500 Hz and a final voltage of 320 V.

The deep black oxide ceramic surface which is accordingly obtained has a film thickness of 8 μm. The remission is 6% at 540 nm.

The process according to the invention provides a coating variant for aluminum cast parts which makes it possible to provide cast parts of very complicated shapes with a finely matted, deep-black surface film by the high enveloping of the plasma-chemical oxidation and to make them suitable e.g. for use in optical equipment construction, particularly where high absorption capabilities and low scattered light components are required.

EXAMPLE 2

A degreased aluminum cast part comprising the alloy G-AlSi7Mg is pickled in a mixture comprising 10 parts nitric acid $HNO_3$ (65-percent)

1 part hydrofluoric acid HF (48-percent)

and 11 parts distilled water at room temperature for 90 s.

After a rinsing process under running water the aluminum cast part is polarized as anode in an electrolyte bath comprising an aqueous solution of 0.6 mole/l =80 g/l potassium dihydrogen phosphate—KH2PO4;

0.5 mole/l=140 g/l sodium carbonate—$Na_2CO_3.10H_2O$ 0.4 mole/l=25 ml/l ethylenediamine and 0.4 mole/l=25 ml/l 25-percent $NH_3$ solution and coated by means of plasma-chemical oxidation at a current density of 0.03 $A \cdot cm^{-2}$, a frequency of 500 Hz and a final voltage of 280 V.

This coating provides a white oxide ceramic surface film with a thickness of 20 μm on the aluminum cast part. The remission is 72% at 540 nm.

In order to verify the precondition for the production of oxide ceramic films by means of plasma-chemical anodic oxidation on silicon-containing aluminum cast parts, which precondition is provided by the pickling, examination is made with the "Jevl" analytic surface electron microscope.

Figure 1:
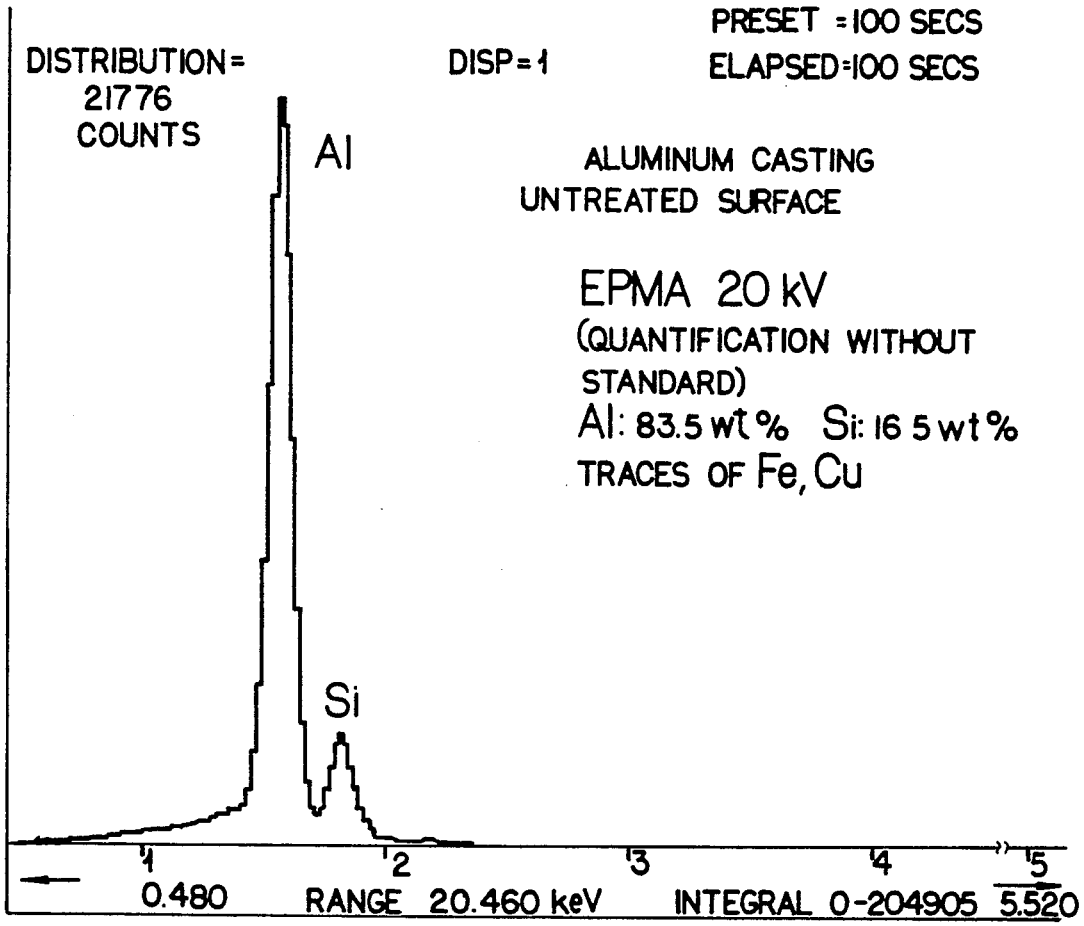
FIG. 1 is a diagram of a surface electron microscope examination of the untreated surface of an aluminum cast part of alloy G-AlSi10Mg.

FIG. 1 shows the diagram of an examination of the untreated surface of an aluminum cast part of the alloy G-AlSi1OMg with the surface electron microscope.

The surfaces under the peaks clearly prove the quantitative distributions of the chief elements of aluminum and silicon on the untreated surface of the work materials.

Figure 2:
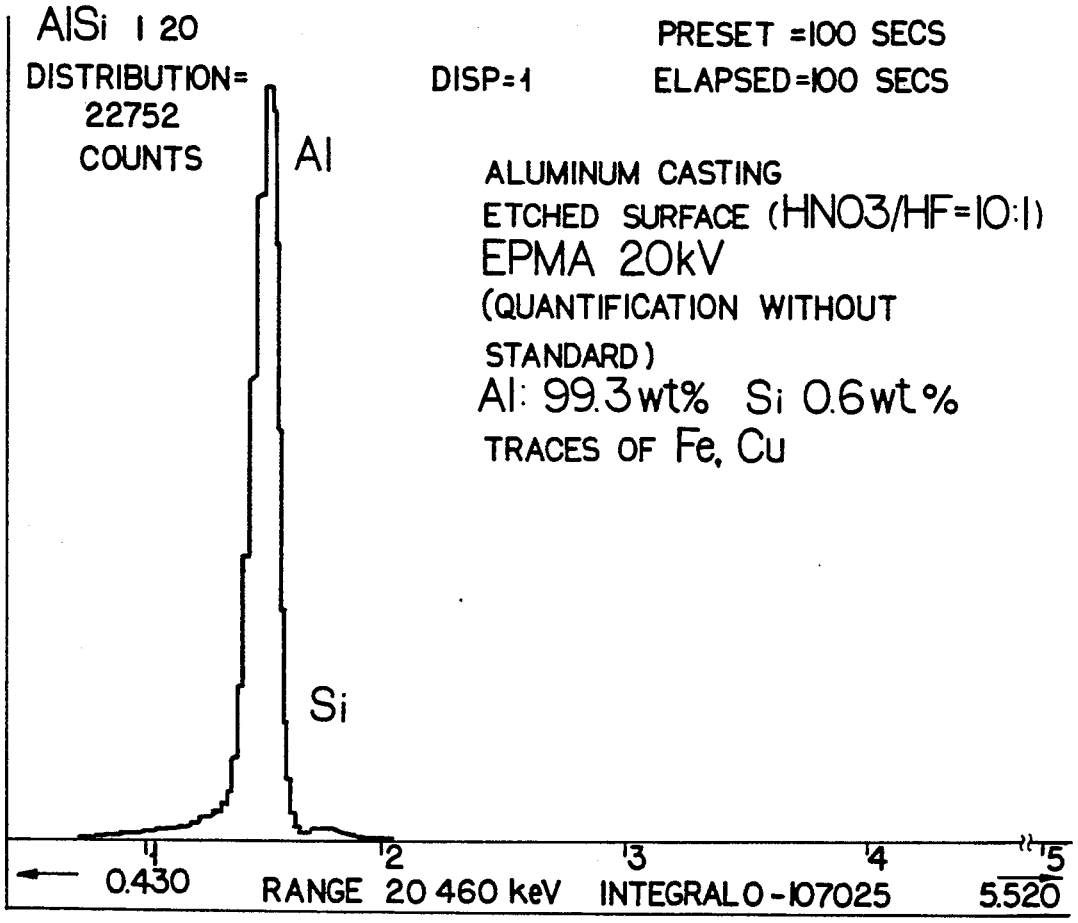
FIG. 2 is a diagram of an electron microscope examination of the pickled surface of the same aluminum cast part.

FIG. 2 shows the diagram of an examination of the pickled surface of the same aluminum cast part with the surface electron microscope.

The clear reduction of the surface under the peak for the element silicon indicates a reduction of this element in the surface film of the cast part in the range of 5 μm, while the surface under the peak for aluminum is maintained in comparison to the unpickled cast part.

It can be concluded that a selective etching of the surface is effected and accordingly the precondition for a coating by means of plasma-chemical anodic oxidation on silicon-containing light metal cast alloys has been provided.

COMPARISON EXAMPLE

Based on DD-PS 249 706 which was named in the background art and describes a selective etching of silicon dioxide or silicon dioxide-containing glasses on aluminum-covered semiconductors, a degreased aluminum cast part comprising the alloy G-AlSilOMg is pickled in a mixture comprising 20 g sodium acetate and 30 ml hydrofluoric acid (40-percent) for 15 s and subsequently subjected to plasma-chemical anodic oxidation in an electrolyte bath of the composition and process parameters of Example 1. It can be verified that no coating is effected by means of plasma-chemical oxidation. This statement is further supported by the significant ratio of the coating parameters of current strength and voltage for the negative curve of the coating variants of plasma-chemical oxidation.

While the foregoing description and drawings represent the preferred embodiments of the present invention, it will be obvious to those skilled in the art that various changes and modifications may be made therein without departing from the true spirit and scope of the present invention.

What is claimed is:

1. Process for the production of oxide ceramic surface films on silicon-containing light metal cast alloys, comprising the steps of:

pickling the light metal cast alloy in a mixture containing 10 parts by volume of a 45–65-percent nitric acid to 1 part by volume of a 30–48-percent hydrofluoric acid; and coating said alloy by means of plasma-chemical anodic, oxidation in an aqueous electrolyte comprising potassium dihydrogen phosphate, potassium chromate, acetate ions, ammonium citrate and ethylenediamine at a current density of 0.01–0.1 $A \cdot cm^{-2}$ of a pulsed current at a frequency of 200–1000 Hz and at a voltage of 250–320 V.

2. Process according to claim 1, wherein an aluminum cast alloy is used as silicon-containing light metal cast alloy.

3. Process according to claim 1, wherein additional water is added to the mixture in which the cast alloy is pickled.

4. Process according to claim 1, wherein the aqueous electrolyte contains 0.59 mole/l potassium dihydrogen phosphate, 0.05 mole/l potassium chromate, 0.35 mole/l copper(II) acetate, 0.22 mole/l ammonium citrate, and 0.38 mole/l ethylenediamine.

5. Process for the production of oxide ceramic surface films on silicon-containing light metal cast alloys, comprising the steps of:

pickling the light metal cast alloy in a mixture containing 10 parts by volume of a 45–65-percent nitric acid to 1 part by volume of a 30–48-percent hydrofluoric acid and coating said alloy by means of plasma-chemical anodic oxidation in an aqueous electrolyte comprising potassium dihydrogen phosphate, sodium carbonate, ethylenediamine and an ammonia solution at a current density of 0.01–0.1 $A \cdot cm^{-2}$ of a pulsed current at a frequency of 200–1000 Hz and at a voltage of 250–320 V.

6. Process according to claim 5, wherein an aluminum cast alloy is used as silicon-containing light metal cast alloy.

7. Process according to claim 5, wherein additional water is added to the mixture in which the cast alloy is pickled.

8. Process according to claim 5, characterized in that the aqueous electrolyte contains 0.6 mole/l potassium dihydrogen phosphate, 0.5 mole/l sodium carbonate, 0.4 mole/l ethylenediamine, and 0.4 mole/l 25-percent ammonia solution.

* * * * *